US009527259B2

(12) United States Patent
Shapiro

(10) Patent No.: US 9,527,259 B2
(45) Date of Patent: Dec. 27, 2016

(54) METHOD OF HOT AIR SEALING POLYMERIC BAG

(71) Applicant: AMS Associates, Inc., Grand Rapids, MI (US)

(72) Inventor: Allen Michael Shapiro, East Grand Rapids, MI (US)

(73) Assignee: ATM, LLC, Grand Rapids, MI (US)

( * ) Notice: Subject to any disclaimer, the term of this patent is extended or adjusted under 35 U.S.C. 154(b) by 0 days.

(21) Appl. No.: 14/626,673

(22) Filed: Feb. 19, 2015

(65) Prior Publication Data

US 2015/0165715 A1 Jun. 18, 2015

Related U.S. Application Data

(60) Division of application No. 13/544,614, filed on Jul. 9, 2012, now abandoned, which is a (Continued)

(51) Int. Cl.
*B31B 1/64* (2006.01)
*B31B 19/64* (2006.01)
(Continued)

(52) U.S. Cl.
CPC ..... *B31B 19/64* (2013.01); *B65D 31/10* (2013.01); *B65D 33/18* (2013.01)

(58) Field of Classification Search
CPC ..... B31B 19/64; B65D 31/10; B65D 33/18
(Continued)

(56) References Cited

U.S. PATENT DOCUMENTS 3,951,050 A * 4/1976 Poole ..... B29C 53/48 156/203
4,353,770 A * 10/1982 Kuckhermann .... B29C 66/9161 156/227

(Continued)

*Primary Examiner* — Sameh Tawfik
(74) *Attorney, Agent, or Firm* — Kutak Rock LLP; Bryan P. Stanley

(57) ABSTRACT

The present invention concerns a gusseted flexible bag, a method of manufacturing the bag, and apparatus for manufacture of said bags, closure devices for such bags and method of sealing the bag. In one embodiment, the flexible bag of the present invention is formed from the tube of material having a front side and a rear side. A pair of laterally disposed opposing gusset folds are formed in the tube along its sides. Each of the folds has a longitudinal crease. The bag further has a rear side flap extending from the rear side of the bag across the width of the tube which is folded over onto and hot air sealed to the front side of the tube of material. The gussets each have a slit approximate a first end of the tube thereby forming a front side flap. A front side flap may also be manufactured, if desired, which is then folded over when the rear side flap is folded so that the front side flat rests under the rear side flap. The rear side flap is hot air sealed to the front side of the bag with the front side flap being sealed therebetween. In the preferred embodiment the tube of material comprises polypropylene film on the exterior of the tube and woven polypropylene film on the interior of the tube. In a preferred embodiment the woven polypropylene film on the inner surface of the rear side flap is sealed to the woven polypropylene film on the inside surface of the front side flap.

12 Claims, 10 Drawing Sheets

Related U.S. Application Data continuation-in-part of application No. 12/817,079, filed on Jun. 16, 2010, now abandoned, which is a continuation-in-part of application No. 11/441,517, filed on May 26, 2006, now abandoned, said application No. 13/544,614 is a continuation-in-part of application No. 12/959,103, filed on Dec. 2, 2010, now abandoned.

(60) Provisional application No. 61/285,151, filed on Dec. 9, 2009.

(51) Int. Cl.
*B65D 30/20* (2006.01)
*B65D 33/18* (2006.01)

(58) Field of Classification Search
USPC ..... 493/192
See application file for complete search history.

(56) References Cited

U.S. PATENT DOCUMENTS 4,498,192 A * 2/1985 Becker ..... B65D 31/10 383/114
4,567,987 A * 2/1986 Lepisto ..... B65D 75/68 383/205
5,021,209 A * 6/1991 Dickinson ..... B29C 49/4817 264/521
5,466,326 A * 11/1995 Cherney ..... B29C 65/10 156/359
5,478,153 A * 12/1995 Feldkamper ..... B65D 31/04 383/111
6,602,174 B1 * 8/2003 Haverfield ..... B29C 65/18 493/191
7,506,487 B2 * 3/2009 Eads ..... B31B 19/36 383/203
7,731,425 B2 * 6/2010 Lin ..... B65D 31/02 383/117
8,333,684 B2 * 12/2012 Colla ..... B31B 19/60 493/210
2004/0105600 A1 * 6/2004 Floyd, Jr. ..... B65D 31/02 383/109
2007/0274614 A1 * 11/2007 Abel ..... B29C 66/1122 383/126
2010/0263332 A1 * 10/2010 Files ..... B32B 27/32 53/453
2011/0103721 A1 * 5/2011 Sargin ..... B31B 19/20 383/120

* cited by examiner 20
14
18
10
Laminated
Polypropylene
Tubes - folded
34
16

14
18
12
Laminated
Polypropylene
Tubes - folding process
20
30
34

14
18
12
Laminated
Polypropylene
Tubes - prefolded
20
30
34
16

Laminated
Polypropylene
Tubes - surface removed
Laminated
Tubes - sur

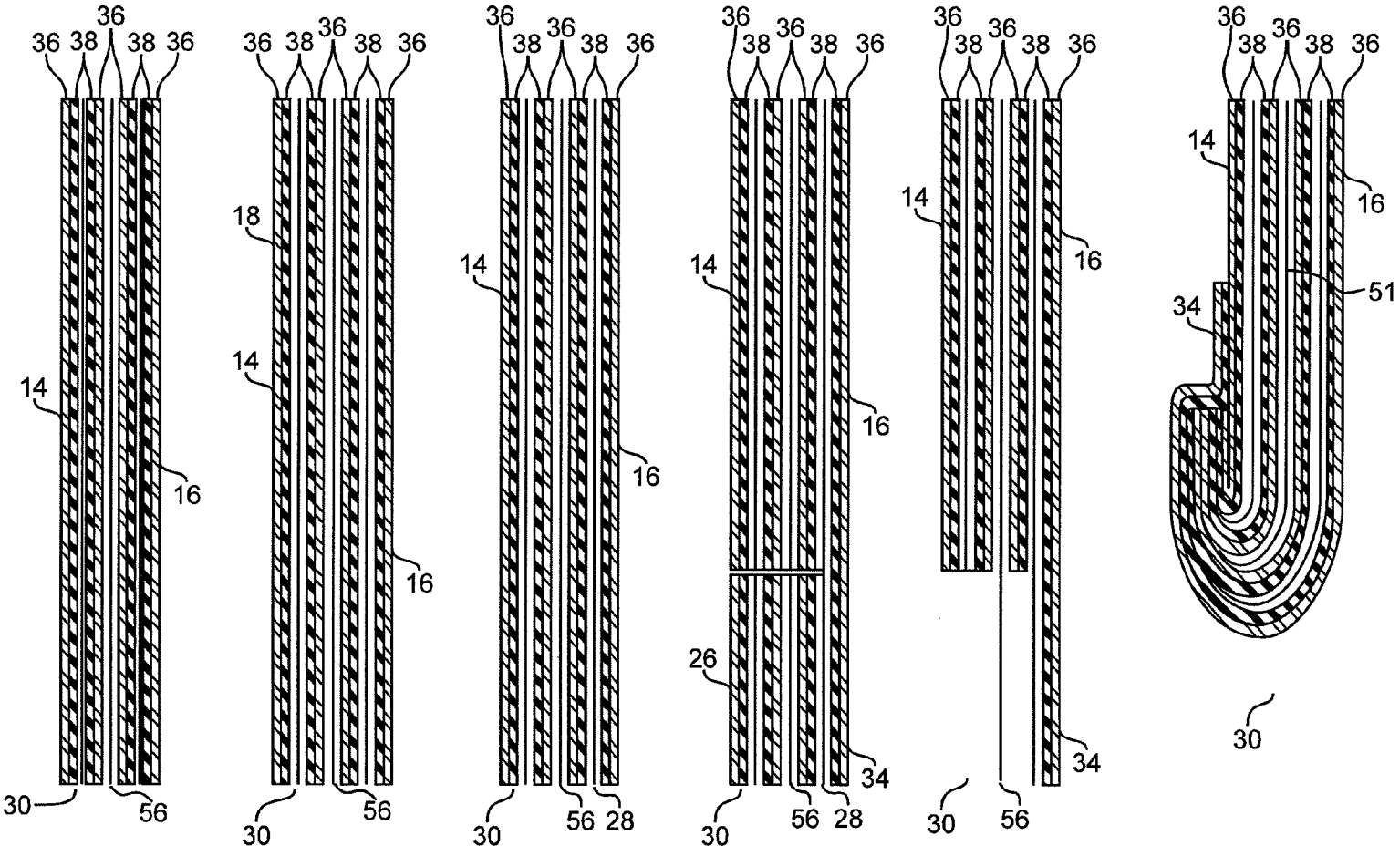
Bag @ Gusset FIG.2A
Bag @ Gusset Expanded FIG.2B
Bag @ Gusset Gusset Set FIG.2C
Bag @ Gusset Top Set FIG.2D
Bag @ Gusset Folded FIG.2E
Bag @ Gusset Folded FIG.2F

METHOD OF HOT AIR SEALING POLYMERIC BAG

CROSS-REFERENCE TO RELATED APPLICATIONS

The present patent application is a divisional application of co-pending U.S. patent application Ser. No. 13/544,614, filed Jul. 9, 2012, which is a continuation-in-part application of U.S. patent application Ser. No. 12/817,079, filed Jun. 16, 2010, entitled Woven Polymeric Bag With Pinch-Bottom Seal And Method Of Making The Same, which is a continuation-in-part application of U.S. patent application Ser. No. 11/441,517, filed May 26, 2006, entitled Method for Closing and Sealing a Woven Polymeric Bag, and a continuation-in-part application of U.S. patent application Ser. No. 12/959,103, filed Dec. 2, 2010, entitled Method For Closing And Sealing A Woven Polymeric Bag, which claims priority pursuant to U.S.C. 119(e) to U.S. Provisional Patent Application No. 61/285,151, filed Dec. 9, 2009, entitled Method For Closing And Sealing A Woven Polymeric Bag, which prior applications are hereby incorporated herein by reference.

FIELD OF THE INVENTION

This invention pertains to a polypropylene woven bag with a pinch bottom seal for the containment and storage of animal feed, pet food and other similar types of contents. More particularly, the invention relates to a woven polypropylene bag that may include a variety of seals for the bottom and/or top of the bag, including a pinch seal.

BACKGROUND OF THE INVENTION

Manufacturers of plastic bags have known for some time to use adhesives to seal the bottom portion of the bag. In particular, the bottom portions of paper bags have been sealed using hot melt adhesive. As is noted in U.S. patent application Ser. No. 11/441,517, filed May 26, 2006, which is the parent of the present application, hot melt adhesives may be used to seal pinch bottom bags. However, for certain applications in which the bottom seal of the bag is severely tested by heavy weight loads, the hot melt adhesive seals sometimes fail. Similarly, use of hot melt adhesives for sealing reclosable fastener profiles to bags can be found in U.S. Pat. No. 4,341,575. Moreover, examples of pinch bottom bags, apparatuses, and methods of manufacturing pinch bottom bags are seen in U.S. Pat. Nos. 6,623,162; 6,599,016; 6,367,976; 6,328,471; 5,791,485; 5,553,943; 5,474,383; 5,021,209; 4,610,651; 4,567,987; 4,550,442; 4,515,273; and 4,344,558. Hot air sealing of polypropopylene to polyethylene using VISTAMAX polypropylene based co-polymer may be found in U.S. Patent Publication No. 2012/0070103, but the principal sealing method disclosed therein is heat activated adhesive.

SUMMARY OF THE INVENTION

The present invention concerns a gusseted flexible bag, a method of manufacturing the bag, an apparatus for manufacture of said bags, closure devices for such bags and methods of sealing the bag.

In one embodiment, the flexible bag of the present invention is formed from a tube of material having a front side and a rear side. A pair of laterally disposed opposing gusset folds are formed in the tube along its sides. Each of the folds has a longitudinal crease. The bag further has a rear side flap extending from the rear side of the bag across the width of the tube which is folded over onto the front side of the tube of material. The gussets each have a slit proximate a first end of the tube thereby forming the rear side flap. The rear side flap is hot air sealed to the front side of the bag. In the preferred embodiment the tube of material comprises polypropylene film on the exterior of the tube and woven polypropylene film on the interior of the tube. In a preferred embodiment the woven polypropylene film on the inner surface of the rear side flap is sealed to the biaxially oriented polypropylene (B.O.P.P.) film on the outside surface of the tube of material. In a preferred embodiment, the polypropylene and woven polypropylene are hot air sealed at a temperature of 375-550° F.

The rear side flap of the flexible bag has a length of 1.75"+/−0.25 inch and the front side flap has a length of 1.5"+/−0.5 inch. The tube of material preferably has a thickness from 5 mm to as much as 50 mm in thickness. The polypropylene film from which the tube of materials is made can be from 5 to 25 mm in thickness and the woven polypropylene film similarly can be from 5 to 25 mm in thickness. The woven polypropylene film is sealed to the polypropylene film on the interior of the bag across substantially all of the inside surface of the B.O.P.P. The polypropylene film is preferably biaxially oriented polypropylene. One means of sealing the polypropylene film to the woven polypropylene film is by means of an intermediate layer of polyethylene and ethylene vinyl acetate. Alternatively the front side flap may be sealed by a means of hot melt adhesive to the rear side flap.

In an alternative embodiment of the invention the front and rear sides of the tube of material are reversed so that the front side flap is sealed to the rear side of the tube. Further, and in an additional alternative embodiment of the invention a pair of laterally disposed opposing gusset folds are again formed in the tube along its sides. Each of the tubes has a longitudinal crease. The bag of the present invention has a front side flap extending from the front side of the bag across the width of the tube which is folded over and hot sealed to the rear side of the tube of material. The gussets each have a slit proximate a first end of the tube thereby forming the rear side flap.

In another embodiment, the flexible bag of the present invention is formed from a tube of material having a front side and a rear side. A pair of laterally disposed opposing gusset folds are formed in the tube along its sides. Each of the folds has a longitudinal crease. The bag further has a rear side flap extending from the rear side of the bag across the width of the tube which is folded over onto and hot air sealed to the front side of the tube of material. The gussets each have a slit proximate a first end of the tube thereby forming a front side flap. The front side flap during manufacture is then folded over when the rear side flap is folded so that the front side flat rests upon the rear side flap. The rear side flap is hot air sealed to the front side of the bag with the front side flap being sealed therebetween. In the preferred embodiment the tube of material comprises polypropylene film on the exterior of the tube and woven polypropylene film on the interior of the tube. In a preferred embodiment the woven polypropylene film on the inner surface of the rear side flap is sealed to the woven polypropylene film on the insider surface of the front side flap.

An additional feature of the invention is a method of sealing a bag formed from a tube of material and having a front side and a rear side and a pair of opposing and inwardly tending gusset folds. Each of the folds has a longitudinal crease. The method comprises the steps of opening the tube of material so as to separate the front side from the rear side. Each of the creases is slit proximate a first end of the tube parallel to the longitudinal axis of the crease thereby obtaining front and rear plies. A strip of material is trimmed from the front surface of the tube and from the gussets proximate the first end of the tube so as to form a bottom flap. The bottom flap is then folded over the top surface of the bag and hot air is applied to seal the bottom flap to the top surface of the bag. The tube may then be cut so as to form a bag sealed at one end. The tube of material preferably comprises woven polypropylene on the inside and polypropylene film on the outside. In one embodiment the top flap and bottom flap may be plasma treated prior to folding and heat sealing to each other in order to facilitate the sealing of the flaps to each other as well as increasing the seal strength. Alternatively, hot melt may be applied to the top flap and the bottom flap so that when folded and compressed against each other and heat sealed the hot melt adhesive melts and seals the bag walls to each other. As an additional alternative, the top flap and bottom flap may be ultrasonically sealed to each other. Again, an additional alternative is to corona treat the top and bottom flaps so as to facilitate sealing of the flaps to each other. Additionally, a score line may be formed along the front side of the tube so as to facilitate folding of the top flap over onto the top wall of the bag. The hot air may be directed against the outside of the bottom flap by means of nozzle which is pressed against the top flap during manufacture of the bag, thereby causing the heat to radiate through the top flap and seal the top flap to the bottom flap.

An alternative method of sealing a bag formed from a tube of material and having a front side and a rear side and a pair of opposing and inwardly tending gusset folds is also disclosed. Each of the folds has a longitudinal crease. The method comprises the steps of opening the tube of material so as to separate the front side from the rear side. Each of the creases is slit proximate a first end of the tube parallel to the longitudinal axis of the crease thereby obtaining front and rear plies. A strip of material is trimmed from the front surface of the tube and from the gussets proximate the first end of the tube so as to form a top flap and a bottom flap. The slits are longer than the strip of material so as to create the top flap after the strip of material has been removed. The top flap is then folded over itself towards the remainder of the tube, i.e., the front surface of the bag. The bottom flap is then folded over the top flap and hot air is applied to seal the top flap to the bottom flap so as to seal both to the top of the bag. Additionally, the bottom flap may extend beyond the top flap so as to seal the top flap to the front surface of the tube. The tube may then be cut so as to form a bag sealed at one end. The tube of material preferably comprises woven polypropylene on the inside and polypropylene film on the outside.

An additional feature of the invention is an apparatus for manufacturing bags comprising polypropylene and woven polypropylene. The apparatus includes an unwinder for unwinding a web of laminated polypropylene and woven polypropylene. A folder folds the web of polypropylene into a tube. A sealer seals the edges of the web of film of polypropylene and woven polypropylene together so as to form a tube. Alternatively, the woven polypropylene can be formed as a tube and a tube of polypropylene film coextruded around the woven polypropylene and sealed to the woven polypropylene contained therein. Gusset forming plows form gussets in the lateral sides of the tube of polypropylene and woven polypropylene. An opener, preferably using a blast of air, opens one end of the tube of polypropylene and woven polypropylene. A slitter then slits the gussets in the tube of polypropylene. A trimmer trims the slit portions of the first end of the tube. In one embodiment a score line may be formed across the tube to facilitate folding of a top flap of the tube over onto itself. A picker then removes the slit portion of the tube from the remainder of the tube. In one embodiment, a folder folds the flap formed by the trimming of the tube, i.e., the top flap 180° back onto the top surface of the tube. A folder then folds the bottom flap of the tube over onto the folded top flap and compresses the top flap against the bottom flap. A hot air sealer seals the top and bottom flaps together so as to form a heat seal of the first end of the tube. A cutter then cuts the tube a desired distance from the first end of the tube; i.e. at a second end as to form a bag sealed at its first end and open at its second end.

In an alternative embodiment of the invention a method of sealing the bag is disclosed which is formed from a tube of material and having a rear side and a front side and a pair of opposing and inwardly tending gusset folds. Each of the folds has a rear and front longitudinal crease. The method comprises the steps of opening the tube of material so as to separate the rear side from the front side. Each of the creases is slit proximate a first end of the tube along the longitudinal axis of the crease thereby obtaining front and rear plies. A strip of material is trimmed from the rear surface of the tube and from the gussets proximate the first end of the tube so as to form a bottom flap after the strip of material has been removed. The bottom flap is then folded over itself towards the remainder of the tube i.e. the top surface of the bag. Hot air is applied to seal the bottom flap to the top surface so as to seal the top of the bag. The tube may then be cut so as to form a bag sealed at one end. The tube of material preferably comprises woven polypropylene on the inside and polypropylene film on the outside. The folding of the bottom flap results in the woven polypropylene on the bottom flap being heat sealed to the B.O.P.P. on the top flap.

In an additional alternative embodiment there is not a bottom flap folded over itself towards the remainder of the tube i.e. the bottom surface of the bag. In this embodiment the top flap is folded over and sealed to the bottom surface of the bag.

The invention further includes an alternative embodiment in which the apparatus for manufacturing bags holds the bottom flap of the tube over onto itself and there is not a top flap. The bottom flap is then sealed to the front surface of the bag using hot air sealing.

The bag of the present invention has a width of 13"+/−3.25 inch, a length of 27.25"+/−6.75" and cross-section at each gusset fold of 5"+/−1.25 inch. The bag of the present invention has a first and second panel and a stepped end. The stepped end includes side gussets of the composite tube which are longer than the first panel and second panel of the composite tube and a flap which extends longer than the side gussets. An inverted zipper assembly having an inverted first flange is bonded to the first panel to form a seal there between. The stepped end is then folded over and bonded to the inverted second flange of the zipper assembly to form a seal there between. The first flange of the bag is bonded to a portion of the first panel and a portion of the first panel which is adjacent to the stepped end. The first panel may be creased and the first inverted flange is bonded to a portion of the first panel whereby the portion of the first panel between the crease and the edge of the first panel is adjacent to the stepped end.

In an additional alternative embodiment of the invention a flexible bag is formed from the tube consisting essentially of a material having an outer layer of polypropylene and an inner layer of woven polypropylene that are directly sealed to one another over the entire surface area of the outer layer and the inner layer. The tube has a front side and a rear side. A pair of opposing inward tending gusset folds are formed in the tube, each of the folds having front and a rear vertical crease. The bag has at least one sealed closure formed by a method comprising the steps of slitting each of the front creases along the longitudinal axis thereof, thereby obtaining front and rear plies. A first rearward fold is formed by rearwardly folding the rear ply together with the rear vertical crease, such that the inner surface of the rear ply is visible. A second rearward fold is then formed by rearwardly folding the first fold wherein the inward surface of the rear ply lies against the rear side of the bag. The method further includes the step of applying hot air to the surface of the rear ply so as to seal the inner surface to the rear side of the bag and applying hot air to the outer surface of the rear ply so as the seals at first rearward fold to set second rearward fold. The invention further includes a bag form of the tube consisting essentially of a polyolefin material and having a front and a rear side. A pair of laterally opposing inward tending gusset folds are formed in the tube, each having front and rear vertical creases. The bag is formed by the method of parting the material longitudinally along the front crease, rolling the rear ply resulting from said step of parting along with the rear portion of the bag proximate to the rear ply, such that a surface of said rear ply opposes the rear side of the bag. The surface of the rear ply is then heat sealed to the rear side of the bag. The material has an outer layer of polypropylene and an inner layer of woven polypropylene that are each directly sealed to one another over the entire surface area of the outer and inner layer. In an alternative embodiment, the bag may be constructed of a polyolefin material having a front side and a rear side. A pair of opposing inward tending gusset folds is formed in the tube, each of the folds having front and rear vertical creases and each of the folds being between the front side and the rear side of the tube. At least one sealed closure is constructed having a front ply and a rear ply. The front ply and the rear ply are separated by a pair of slits along the front creases along the longitudinal axis thereof and the rear ply has an inner and outer surface. A first rearward fold causes the outer surface of the rear ply to oppose a first portion of the rear side of the bag. A second rearward fold causes the inner surface of the rear ply to oppose a second portion of the rear side of the bag. The material has an outer layer of polypropylene and an inner layer of woven polypropylene that are each directly sealed to one another over the entire surface of the outer layer and the inner layer. In a preferred embodiment, the inner surface is hot air sealed to the rear ply. The bag is preferably hot air sealed at a temperature between 375 and 550 degrees Fahrenheit.

BRIEF DESCRIPTION OF THE DRAWINGS

Embodiments are disclosed herein with reference to the accompanying drawings. In the drawings, like reference numbers indicate identical or functionally similar elements.

FIG. 2A is a sectional view of the lateral side of a tube of material.

FIG. 2B is an expanded sectional view of the lateral side of a tube of material.

FIG. 2C is a sectional view of the lateral side of a tube of material with a gusset slit.

FIG. 2D is a sectional view of the lateral side of a tube of material with a strip of material separated.

FIG. 2E is a sectional view of the lateral side of a tube of material with a separated strip of material.

FIG. 2F is a sectional view of the lateral side of a tube of material with a fold.

DETAILED DESCRIPTION OF A PREFERRED EMBODIMENT

A The various embodiments of the present disclosure and their advantages are best understood by referring to FIGS. 1A through 9 of the drawings. The elements of the drawings are not necessarily to scale, emphasis instead being placed upon clearly illustrating the principles of the disclosure. Throughout the drawings, like numerals are used for like and corresponding parts of the various drawings.

The drawings represent and illustrate examples of the various embodiments of the disclosure, and not a limitation thereof. It will be apparent to those skilled in the art that various modifications and variations can be made in the present disclosures without departing from the scope and spirit of the disclosure as described herein. For instance, features illustrated or described as part of one embodiment can be included in another embodiment to yield a still further embodiment. Moreover, variations in selection of materials and/or characteristics may be practiced to satisfy particular desired user criteria. Thus, it is intended that the present disclosure covers such modifications as come within the scope of the features and their equivalents.

Figures 1A, 1B, 1C:
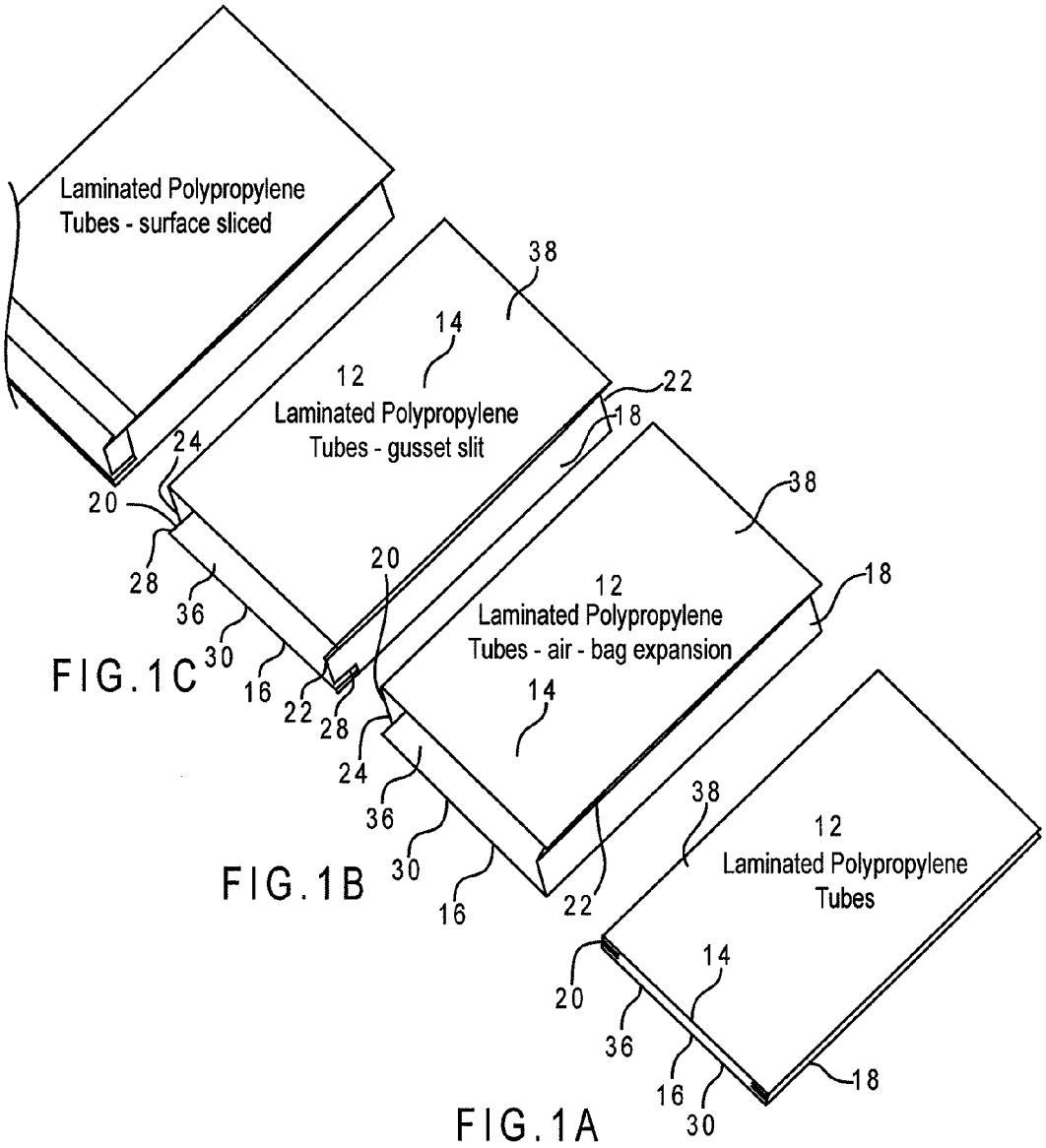
FIG. 1A is a perspective view of a tube of material.
FIG. 1B is a perspective view of an expanded tube of material.
FIG. 1C is a perspective view of an expanded and slit tube of material.
Figures 1D, 1E:
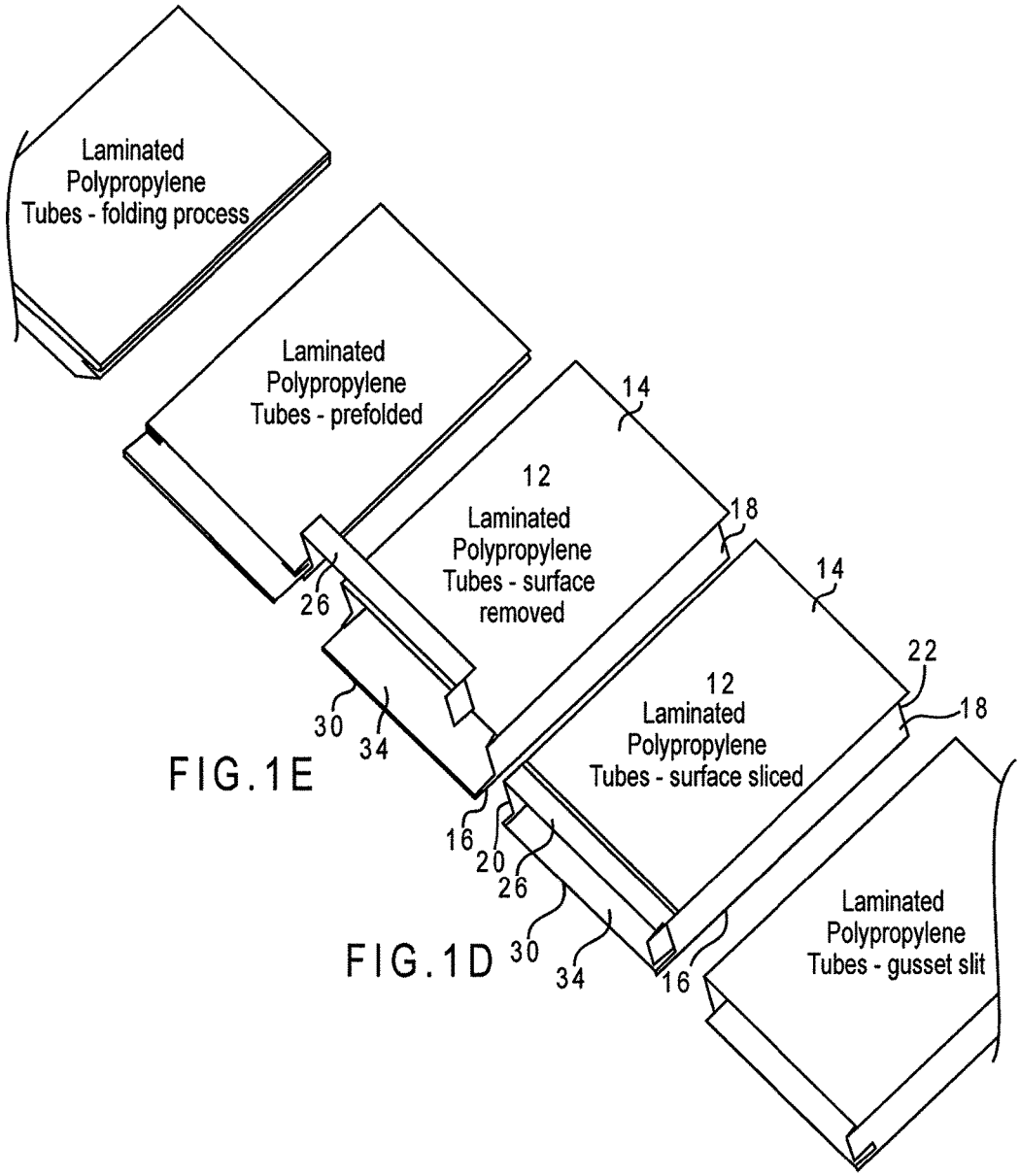
FIG. 1D is a perspective view of an expanded tube of material with a strip of material removed.
FIG. 1E is a perspective view of an expanded tube of material with a strip of material removed.
Figures 1F, 1G, 1H:
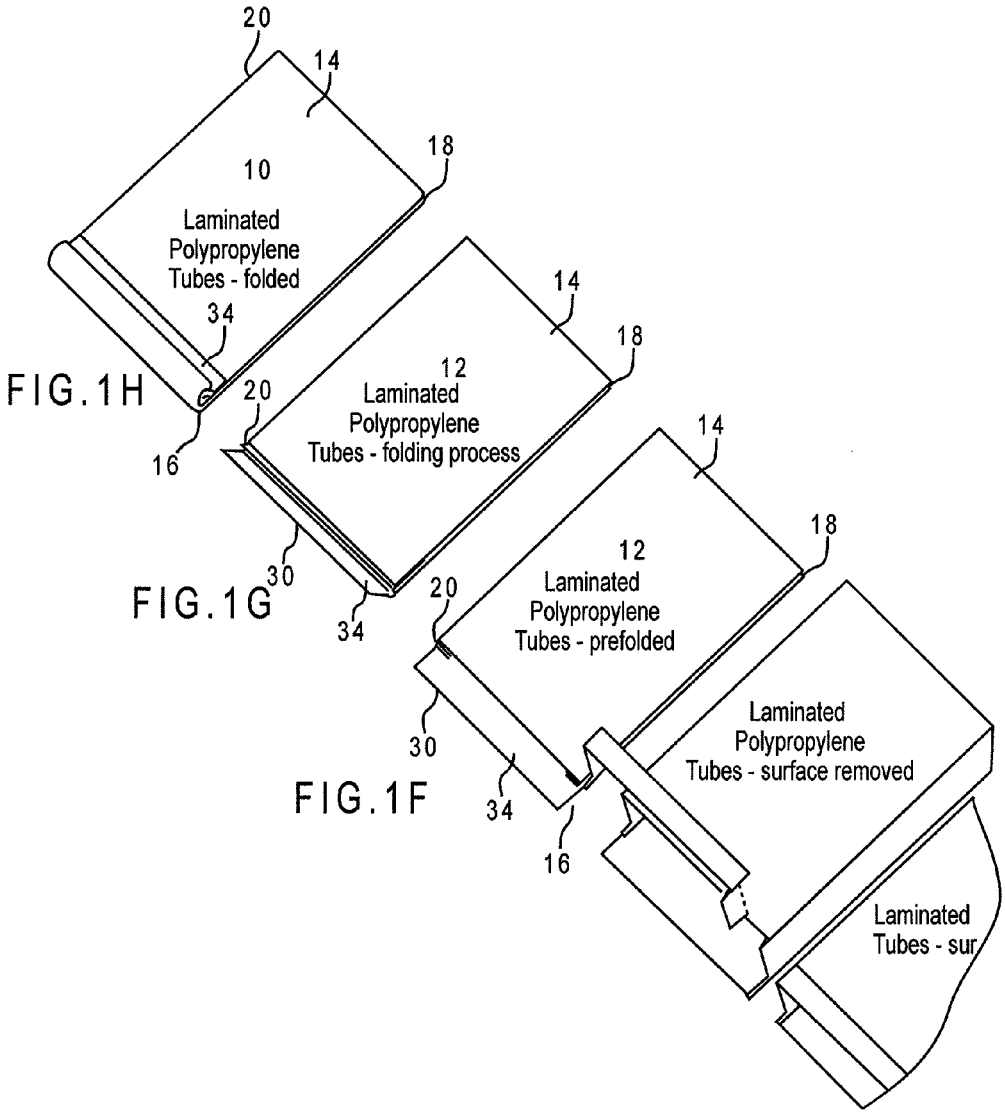
FIG. 1F is a perspective view of a tube of material with a strip of material removed.
FIG. 1G is a perspective view of a tube of material with a partially-folded flap.
FIG. 1H is a perspective view of a tube of material with a folded flap.

FIGS. 1A through 1F generally depict a flexible bag 10 in accordance with one embodiment of the claimed invention. As shown in FIG. 1A, a flexible bag 10 of the present invention is formed from a tube of material 12 having a front side 14 and a rear side 16. As will be understood by one of skill in the art, the front side 14 can also be referred to as a top side while the rear side 16 could also be referred to as the bottom side of the tube 12. The tube 12 has an interior surface 36 and an exterior surface 38. A pair of laterally disposed opposing gusset folds 18 and 20 are formed in the tube 12 along its lateral sides. As shown in FIG. 1B, each of the folds 18 and 20 has an inward longitudinal crease 22 and 24. With reference to FIG. 1C, the gussets 18 and 20 each have a slit 28 proximate a first end 30 of the tube 12. Each slit 28 is created parallel to the longitudinal axis of each crease 22 and 24. As shown in FIGS. 1D and 1E, a strip of material 26 is trimmed and removed from the front side 14 and the gusset folds 18 and 20 at the first end 30 of the tube of material 12, thereby forming a rear side flap 34. As shown in FIG. 1F, the rear side flap 34 extends across the width of the tube. With reference to FIG. 1G, the rear side flap 34 and a portion of the front side 14 including the gusset folds 18 and 20 is folded over onto the front side 14 of the tube of material 12. As shown in FIG. 1H, the rear side flap 34 is hot air sealed to the front side 14 of the bag 10.

FIGS. 2A through 2F depict a longitudinal cross section of the bag 10, taken through one of the gusset folds 18 of the tube 12 and showing the longitudinal axis 56 of the tube 12. As will be understood by one of skill in the art, the cross section through the other gusset fold 20 would appear substantially similar. As shown in FIGS. 2A and 2B, the tube of material 12 has an inner surface 36 and an outer surface 38. FIG. 2C depicts the tube of material 12 following the formation of the gusset slits 28. FIG. 2D shows the strip of material 26 separated from the tube 12 but not yet removed. With reference to FIG. 2E, the strip of material 26 has been completely removed, forming the rear side flap 34. In FIG. 2F, the rear side flap 34 and a portion of the front side are folded over onto the front side 14 of the bag 10.

Figure 3A:
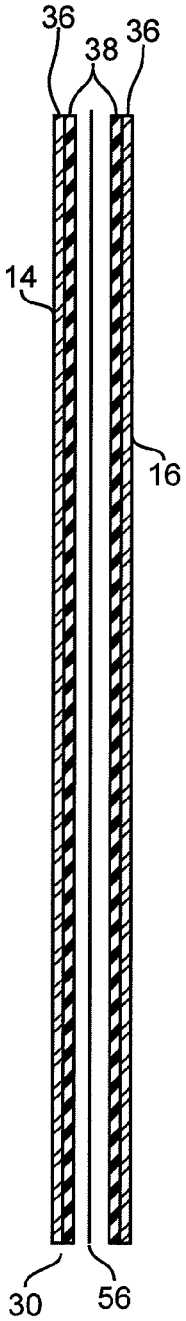
FIG. 3A is a sectional view of the central portion of a tube of material.
Figure 3B:
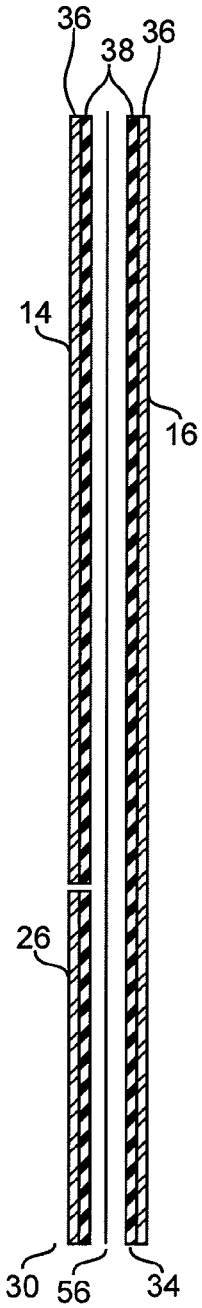
FIG. 3B is a sectional view of the central portion of a tube of material with a separated strip of material.
Figure 3C:
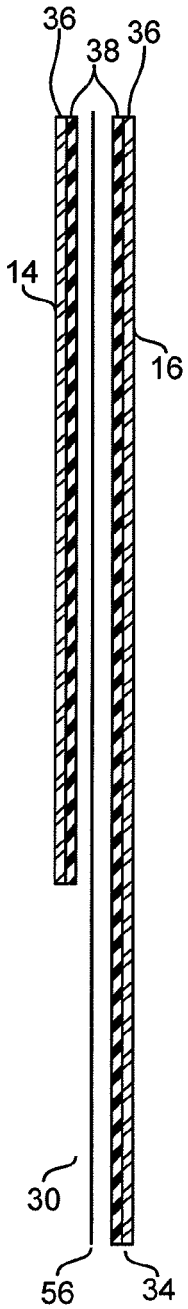
FIG. 3C is a sectional view of the central portion of a tube of material with a strip of material removed.
Figure 3D:
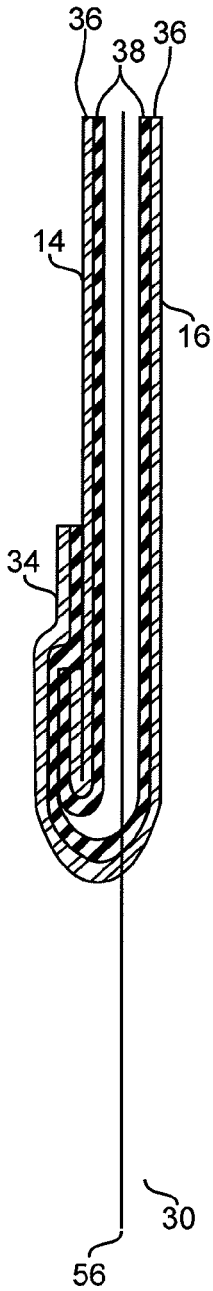
FIG. 3D is a sectional view of the central portion of a tube of material with a fold.

FIGS. 3A through 3D depict a longitudinal cross section of the bag 10, taken through the central portion of the bag 10 away from the gusset folds 18 and 20 showing the longitudinal axis 56 of the tube 12. The inner surface 36 and outer surface 38 of the front side 14 and rear side 16 are shown in FIG. 3A. FIG. 3B depicts the strip of material 26 separated from the remainder of the tube 12, but not yet removed. FIG. 3C shows the strip of material 26 fully removed, leaving the rear side flap 34. As shown in FIG. 3D, the rear side flap 34 and a portion of the front side 14 are folded over onto the front side 14 of the bag 10.

In an alternative embodiment of the invention, the bag 10 is substantially as described above except the front side 14 and rear side 16 of the tube of material 12 are reversed so that a front side flap is sealed to the rear side 16 of the tube.

Figure 4A:
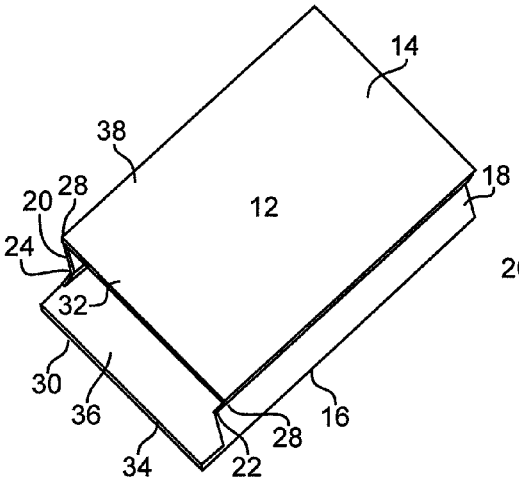
FIG. 4A is a perspective view of an expanded tube of material with a strip of removed and a gusset slit.
Figure 4B:
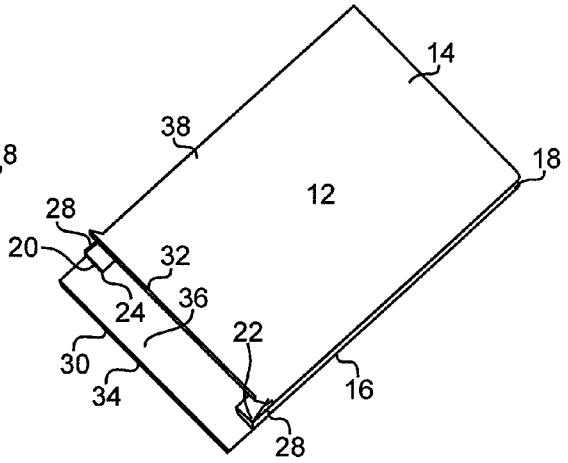
FIG. 4B is a perspective view of an expanded tube of material with a partially-folded top flap.
Figure 4C:
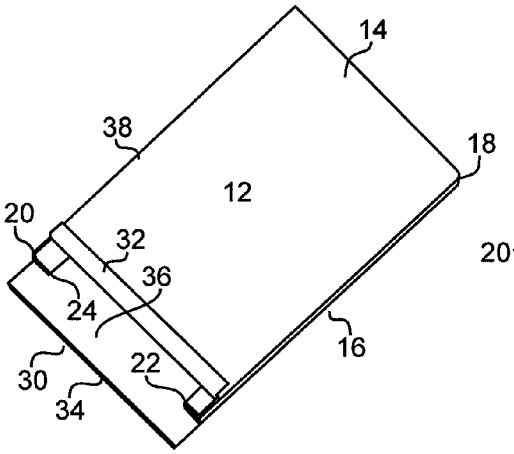
FIG. 4C is a perspective view of an expanded tube of material with a folded top flap.
Figure 4D:
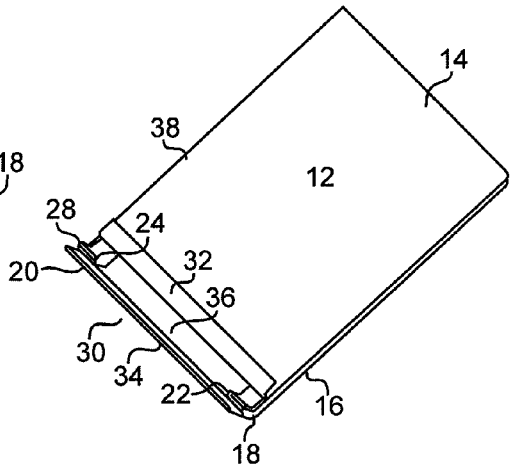
FIG. 4D is a perspective view of an expanded tube of material with a partially-folded bottom flap.
Figure 4E:
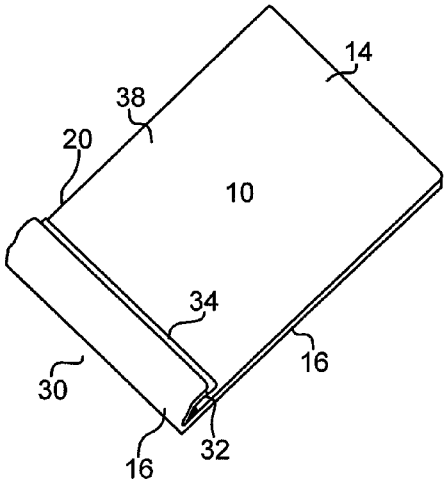
FIG. 4E is a perspective view of an expanded tube of material with a folded bottom flap.

Another embodiment of a flexible bag 10 made in accordance with the present invention is shown in FIGS. 4A through 4E. As described above and depicted in FIG. 4A, a flexible bag is formed from a tube of material 12 having a front side 14 and a rear side 16. A pair of laterally disposed opposing gusset folds 18 and 20 are formed in the tube 12 along its sides. Each of the folds 18 and 20 has an inward longitudinal crease 22 and 24. The bag 10 further has a rear side flap 34 extending across the width of the tube 12. A slit 28 is formed in each of the gussets 18 and 20 proximate the front side 14 of a first end 30 of the tube 12 thereby forming a front side flap 32. As shown in FIGS. 4B and 4C, the front side flap 32 is folded over against the front side 14 during manufacture. Optionally, the front side flap 32 is hot air sealed to the front side 14 of the tube of material 12. As shown in FIGS. 4D and 4E, the rear side flap 34 is also folded over so that the front side flap 32 rests between the rear side flap 34 and the front side 14 of the bag 10. The rear side flap 34 is hot air sealed to the front side 14 of the bag 10 with the front side flap 32 being sealed therebetween.

In a preferred embodiment, the tube of material 12 comprises polypropylene film on the exterior surface 38 of the tube 12 and woven polypropylene film on the interior surface 36 of the tube 12. The polypropylene film forming the interior side is further preferably biaxially oriented polypropylene (B.O.P.P.). The woven polypropylene film forming the inner surface 36 of the bag 10 is sealed to the polypropylene film forming the exterior surface 38 of the bag across substantially all of the interior surface of the polypropylene film. The woven polypropylene film on the inner surface 36 of the rear side flap 34 is sealed to the polypropylene film on the outer surface 38 of the front side 14 of the tube of material 12. Alternatively, the rear side flap 34 may be sealed by a means of hot melt adhesive to the front side 14 of the bag 10. In a preferred embodiment, the woven polypropylene film on the inner surface 36 of the rear side flap 34 is sealed to the woven polypropylene film on the inner surface 36 of the front side flap 32. In a preferred embodiment, the polypropylene and woven polypropylene are hot air sealed at a temperature from 375 to 550° F. In an alternative embodiment, the polypropylene film forming the outer surface 38 of the bag 10 and the woven polypropylene film forming the interior surface 36 of the bag 10 are sealed together by means of an intermediate layer of polyethylene and ethylene vinyl acetate. In the preferred embodiment, the rear side flap 34 of the flexible bag 10 has a length of 1.75"+/−0.25 inches and the front side flap 32 has a length of 1.5"+/−0.5 inches. The tube of material 12 preferably is between 5 mm and 50 mm in thickness. The polypropylene film forming the outer surface 38 of the tube of materials 12 is from 5 to 25 mm in thickness and the woven polypropylene film forming the inner surface 36 of the tube 12 similarly can be from 5 to 25 mm in thickness.

Returning to FIGS. 1A through 1H, an additional feature of the present invention is a method of sealing a bag 10. As described above and with reference to FIG. 1A, the method begins with a tube of material 12 having a front side 14 and a rear side 16 and a pair of opposing and inwardly tending gusset folds 18 and 20. Such tube of material is created through conventional means. Each of the folds 18 and 20 has a longitudinal crease 22 and 24, respectively. First, as shown in FIG. 1B, the tube of material 12 is opened so as to separate the front side 14 from the rear side 16. Next, as shown in FIG. 1C, each of the creases 22 and 24 is slit proximate a first end of the tube 30 parallel to the longitudinal axis of the crease 22 or 24, thereby obtaining a front ply 58 and a rear ply 60. As shown in FIGS. 1D and 1E, a strip of material 26 is trimmed from the front surface 14 of the tube 12 and from the gussets 18 and 20 proximate the first end 30 of the tube 12 so as to form a rear side flap 34. Next, as shown in FIG. 1F, the tube 12 is flattened. With reference to FIGS. 1G and 1H, the rear side flap 34 is then folded over the front surface 14 of the bag 10 and hot air is applied to seal the rear side flap 34 to the front surface 14 of the bag 10. The tube 12 may then be cut so as to form a bag 10 sealed at one end 30. The tube of material 12 preferably comprises woven polypropylene on the interior surface 36 and polypropylene film on the exterior surface 38.

With reference to FIG. 1A, an alternative method of sealing a bag 10 formed from a tube of material 12 and having a front surface 14 and a rear surface 16 and a pair of opposing and inwardly tending gusset folds 18 and 20 is also disclosed. Each of the folds 18 and 20 has a longitudinal crease 22 and 24, respectively. As shown in FIG. 1B, the method comprises the steps of opening the tube of material 12 so as to separate the front side 14 from the rear side 16. As shown in FIG. 1C, each of the creases is slit 28 proximate the rear side 16 of a first end 30 of the tube 12 parallel to the longitudinal axis of each crease 22 and 24. As shown in FIG. 1D, a strip of material 26 is trimmed from the front surface 14 of the tube 12 and from the gussets 18 and 20 proximate the first end 30 of the tube 12 so as to form a rear flap 34. As shown in FIG. 4A, a second pair of opposing slits 28 are formed proximate the front side 14 of the first end 30 of the tube 12 parallel to the longitudinal axis of each crease 22 and 24, so as to form a front flap 32. Alternatively, the pair of slits 28 proximate the front side 14 of the tube 12 can be formed prior to removal of the strip of material 26, in which case the slits 28 proximate the front side 14 of the tube 12 will be longer than the strip of material 26 so as to create the front flap 32 after the strip of material 26 has been removed. The separated portion of the front side 14 comprising the front flap 32 may be referred to as a front ply. Similarly, the separated portion of the rear side 16 comprising the rear flap 34 may be referred to as the rear ply. As shown in FIGS. 4B and 4C, the front flap 32 is then folded over itself towards the front surface 14 of the remainder of the tube 12. As shown in FIGS. 4D and 4E, the rear flap 34 is then folded over the front flap 32 and the front flap 32 is sealed to the bottom flap 34 through the application of hot air, so as to seal both flaps 32 and 34 to the front surface 14 of the bag 10. Additionally, the rear flap 34 may extend beyond the front flap 32 so as to seal the front flap 32 to the front surface 14 of the tube 12. The tube 12 may then be cut opposite the first end 30 so as to form a bag 10 sealed at one end 30. The tube of material 12 preferably comprises woven polypropylene on the interior surface 36 and polypropylene film on the exterior 38.

In an alternative embodiment, the front side 14 and rear side 16 may be reversed, so that a rear flap is folded over onto the rear side and a front flap is folded over the rear flap onto the rear side. As will be understood by one of skill in the art, the front side may also be referred to as the top side, while the rear side may also be referred to as the bottom side.

In one embodiment the front flap 32 and rear flap 34 may be plasma treated prior to folding and heat sealing to each other in order to facilitate the sealing of the flaps 32 and 34 to each other as well as increasing the seal strength. Alternatively, hot melt may be applied to the front flap 32 and the rear flap 34 so that when folded and compressed against each other and heat sealed the hot melt adhesive melts and seals the flaps to each other and to the front surface 14 of the bag. As an additional alternative, the front flap 32 and rear flap 34 may be ultrasonically sealed to each other. Again, an additional alternative is to corona treat the front and rear flaps 32 and 34 so as to facilitate sealing of the flaps to each other. Optionally, a score line may be formed along the front side 14 of the tube 12 so as to facilitate folding of the front flap 32 over onto the front surface 14 of the bag 10. Additionally, hot air may be directed against the outside of the rear flap 34 by means of nozzle which is pressed against the front flap 32 during manufacture of the bag, thereby causing the heat to radiate through the front flap 32 and seal the front flap 32 to the rear flap 34.

An additional feature of the invention is an apparatus for manufacturing bags comprising polypropylene and woven polypropylene. The apparatus includes an unwinder for unwinding a web of laminated polypropylene and woven polypropylene. A folder folds the web of polypropylene into a tube. A sealer seals the edges of the web of film of polypropylene and woven polypropylene together so as to form a tube 12. Alternatively, the woven polypropylene can be formed as a tube and a tube of polypropylene film coextruded around the woven polypropylene and sealed to the woven polypropylene contained therein. Gusset forming plows form gussets in the lateral sides of the tube 12 of polypropylene and woven polypropylene. The tubes 12 are then stacked into a stack of tubes 40.

Figure 5:
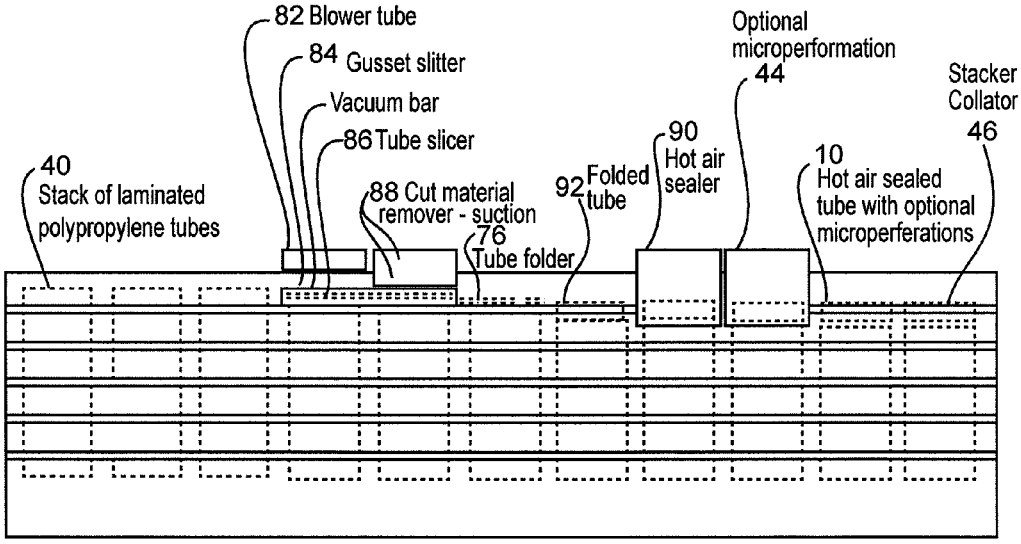
FIG. 5 is a schematic view of a portion of an assembly for forming a bag from a tube of material using a hot air sealer.

With reference to FIG. 5, a stack of tubes 40 is then provided to an opener 82 which opens one end 30 of the tube 12 of polypropylene and woven polypropylene, preferably using a blast of air. In one embodiment, the opener 82 comprises a blower tube. A gusset slitter 84 then slits the gussets 18 and 20 in the tube 12 of polypropylene. A trimmer 86 trims the slit portions of the first end 30 of the tube 12 so as to form a front flap 32, a rear flap 34, or both. In one embodiment, only a single pair of slits are made parallel to the longitudinal axis of the crease of each gusset fold 18 and 20, thereby producing a single flap (either a front flap 32 or a rear flap 34). In an alternative embodiment, each gusset fold 18 and 20 has both a front outward crease and a rear outward crease. Both creases are slit along the longitudinal axis of the fold, thereby producing both a front flap 32 and a rear flap 34. Optionally, a score line may be formed across the tube 12 to facilitate folding of a front flap 32 or a rear flap 34 of the tube 12 over onto itself. A picker 88 then removes the slit portion 26 of the tube 12 from the remainder of the tube. The picker 88 for example can use suction to remove the slit portion 26. In one embodiment, to create a bag 10 such as that depicted in FIGS. 4A through 4E, folder 76 folds the front flap 32 formed by the trimming of the tube 12 180° back onto the front surface 14 of the tube 12. A folder 76 then folds the rear flap 34 of the tube 12 over onto the folded front flap 32 and compresses the front flap 32 against the rear flap 34. A hot air sealer 90 seals the top flap 64 and bottom flap 66 of the folded tube 42 together so as to form a heat seal at the first end 30 of the tube 12. As will be understood by one of skill in the art, alternatively, the front side 14 and rear side 16 could be reversed, such that the rear flap 34 is folded back 180° to the rear side 16 of the tube 12. In another embodiment, there is only a single flap, which is folded over and sealed to the opposite surface of the bag. For example, if there is only a front flap 32, it will be folded over and sealed to the rear surface 16 of the bag. Optionally, the tube 12 can be perforated after being sealed by a perforator 44. A cutter 92 then cuts the tube 12 a desired distance from the first end 30 of the tube 12 so as to form a bag 10 sealed at its first end 30 and open at the other end. Optionally, a stacker/collator 46 stacks each bag 10.

Figure 6:
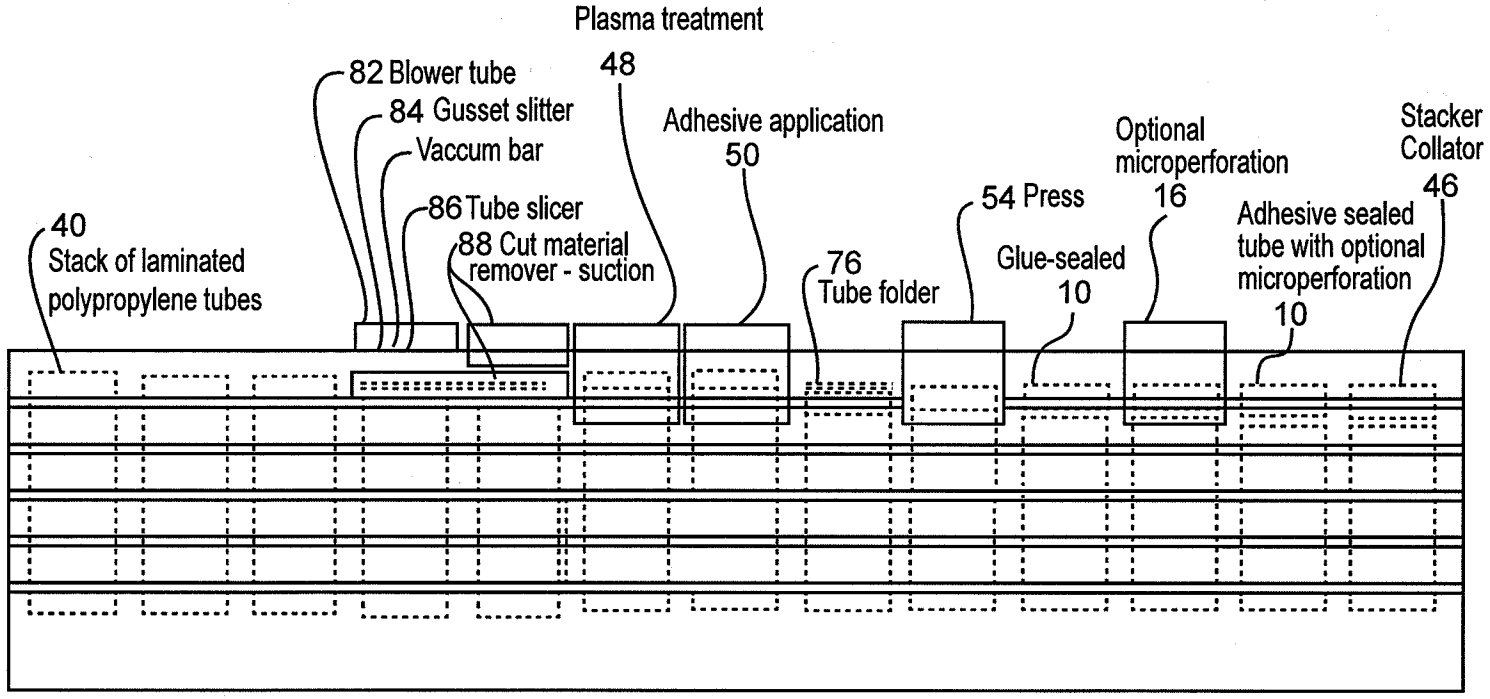
FIG. 6 is a schematic view of a portion of an assembly for forming a bag from a tube of material using adhesive.

With reference to FIG. 6, in an alternative embodiment, the apparatus treats the tubes 12 with plasma using a plasma treater 48 before applying adhesive using adhesive applier 50, thereby producing a bag sealed with adhesive. In one embodiment, the adhesive used is glue. Other possible adhesives will be readily recognized by those of skill with the art.

Preferably, the tube of material 12 preferably comprises woven polypropylene on the inside 36 and polypropylene film on the outside 38, where the polypropylene film is B.O.P.P. The folding of the rear flap 34 results in the woven polypropylene on the rear flap 34 being heat sealed to the B.O.P.P. on the front flap 32.

Figure 7:
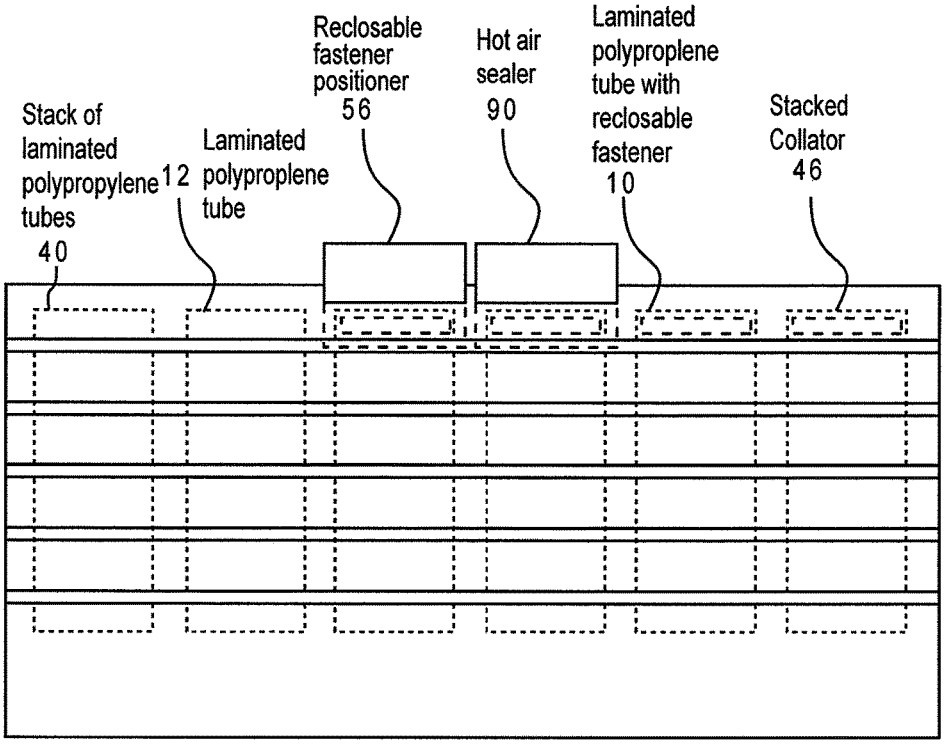
FIG. 7 is a schematic view of a portion of an assembly for forming a bag with a reclosable-fastener from a tube of material.

In a preferred embodiment, the bag has a width of 13"+/−3.25 inch, a length of 27.25"+/−6.75" and cross-section at each gusset fold of 5"+/−1.25 inch With reference to FIG. 7, in yet another embodiment of the present invention, an apparatus for installing a reclosable fastener is provided. A stack of laminated polypropylene tubes 40 is provided to a reclosable fastener positioner 56, which positions a reclosable fastener, such as inverted zipper assembly 104 shown in FIG. 8. A sealer, such as a hot air sealer 90, then attaches the reclosable fastener to the tube 12 to produce a bag with a reclosable fastener. As will be clear to one of skill in the art, such an apparatus could be either used in combination with those apparatuses described hereinabove or individually. Optionally, each bag 10 is stacked by a stacker/collator 46.

Figure 8:
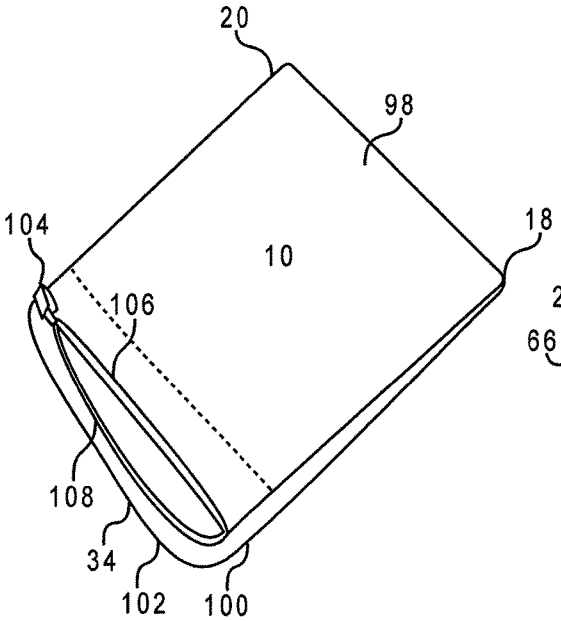
FIG. 8 is a perspective view of a bag sealed with an inverted zipper assembly.

With reference to FIG. 8 and the disclosure of U.S. patent application Ser. No. 12/817,079, the disclosure of which is incorporated herein in its entirety, the bag of one embodiment of the present invention has a first panel 98 and a second panel 100 and a stepped end 102. The stepped end 102 includes side gussets 18 and 20 of the composite tube 12 which are longer than the first panel 98 and second panel 100 of the composite tube 12 and a flap 34 which extends longer than the side gussets 18 and 20. An inverted zipper assembly 104 having an inverted first flange 106 is bonded to the first panel 98 to form a seal there between. The stepped end 102 is then folded over and bonded to the inverted second flange 108 of the zipper assembly 102 to form a seal there between. The first flange 106 is bonded to a portion of the first panel 98 which is adjacent to the stepped end 102. Optionally, the first panel 98 has a crease 110 and the first inverted flange 106 is bonded to a portion of the first panel 98 between the crease 110 and the edge of the first panel 98 adjacent to the stepped end 102.

Figure 9:
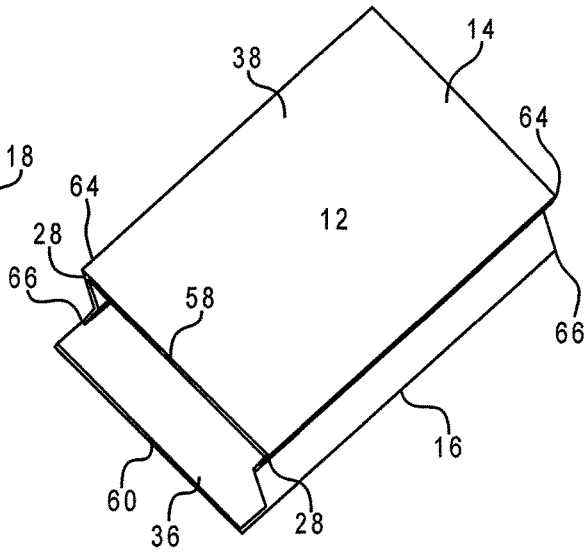
FIG. 9 is a perspective view of an expanded tube of material prior to being sealed with a rearward fold.

With reference to FIG. 9 and U.S. patent application Ser. No. 13/011,620, the disclosure of which is incorporated herein in its entirety, in an additional alternative embodiment of the invention, a flexible bag is formed from a tube 12 consisting essentially of a material having an outer layer 38 of polypropylene and an inner layer 36 of woven polypropylene that are directly sealed to one another over the entire surface area of the outer layer 38 and the inner layer 36. The tube 12 has a front side 14 and a rear side 16. A pair of opposing inward tending gusset folds 18 and 20 are formed in the tube, each of the folds 18 and having front outward vertical crease 64 and a rear outward vertical crease 66. The bag 10 has at least one sealed closure formed by a method comprising the steps of slitting 28 each of the front creases 64 along the longitudinal axis thereof, thereby obtaining a front ply 58 and a rear ply 60. As shown in U.S. patent application Ser. No. 13/011,620, a first rearward fold is formed by rearwardly folding the rear ply 60 together with the rear vertical crease 66, such that the inner surface 36 of the rear ply 60 is visible. A second rearward fold is then formed by rearwardly folding the first fold wherein the inward surface of the rear ply 36 lies against the outer surface 38 of the rear side 16 of the bag 10. The method further includes the step of applying hot air to the surface of the rear ply so as to seal the inner surface to the rear side of the bag and applying hot air to the outer surface of the rear ply so as the seals at first rearward fold to set second rearward fold.

In an alternative embodiment, a bag is formed by rolling the rear ply 60 resulting from the parting along the front vertical creases 64 with the rear portion of the bag proximate to the rear ply 60, such that the outer surface 38 of the rear ply 60 opposes the rear side 16 of the bag 10. The rear ply 16 is then heat sealed to the rear side 16 of the bag 10.

As shown in FIG. 9 and FIGS. 4-7 of U.S. patent application Ser. No. 13/011,620, in an alternative embodiment, the bag may be constructed of a polyolefin material having a front side and a rear side. A pair of opposing inward tending gusset folds is formed in the tube, each of the folds having front and rear vertical creases and each of the folds being between the front side and the rear side of the tube. At least one sealed closure is constructed having a front ply and a rear ply. The front ply and the rear ply are separated by a pair of slits along the front creases along the longitudinal axis thereof and the rear ply has an inner and outer surface. A first rearward fold causes the outer surface of the rear ply to oppose a first portion of the rear side of the bag. A second rearward fold causes the inner surface of the rear ply to oppose a second portion of the rear side of the bag. The material has an outer layer of polypropylene and an inner layer of woven polypropylene that are each directly sealed to one another over the entire surface of the outer layer and the inner layer. In a preferred embodiment, the inner surface is hot air sealed to the rear ply. The bag is preferably hot air sealed at a temperature between 375 and 550 degrees Fahrenheit.

Figure 10:
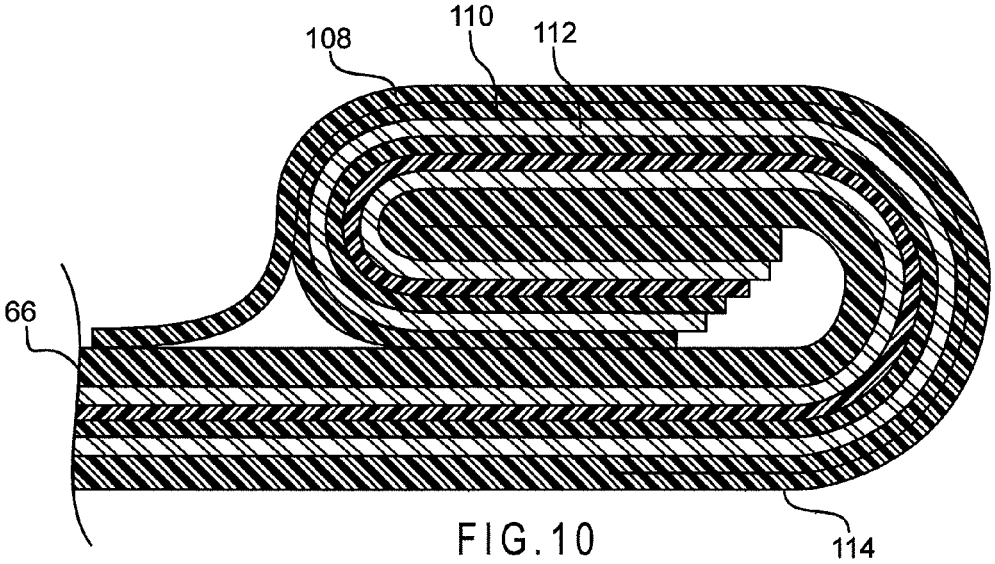
FIG. 10 is an elevation view of a partial section of the bag illustrating one embodiment of this disclosure.

FIG. 10 is an elevation view of a portion of one embodiment of the present disclosure similar to and as discussed with respect to FIGS. 2-7. In this embodiment a polypropylene layer 108 is oriented as the outer, exterior layer of the bag. Inside of the polypropylene layer 108 is a woven polypropylene inner layer 110. Note cross hatchings on first woven propylene inner layer 110. An intermediate layer or extrusion layer 112 may be adjacent first woven polypropylene inner layer 110. Intermediate layer 112 may be polypropylene polyethylene, blends of polyethylene, polypropylene, blends of polypropylene or any other suitable material or combination for the intended functionality as described herein. It is used to seal the outer polypropylene layer 108 to first polypropylene inner layer 110 such that the outer polypropylene layer 108 is bonded, laminated or otherwise connected on its surface to the extrusion layer 112 and likewise with the first woven polypropylene inner layer 110. Woven polypropylene inner layer 110 provides strength to the outer layer, polypropylene layer 66.

Another inner layer 114 may be present as the innermost layer of the bag, which contacts the contents of the bag and maybe made of a material that is compatible with the first woven polypropylene inner layer 110 and with the contents of the bag. A second woven polypropylene inner layer 116 may be positioned between the extrusion layer 112 and the polypropylene layer 66 with an inner polypropylene layer 118 positioned between the extrusion layer 112 and the second woven polypropylene inner layer 116. A second extrusion layer 120 may separate the second polypropylene inner layer 116 from the polypropylene layer 66.

Figure 11:
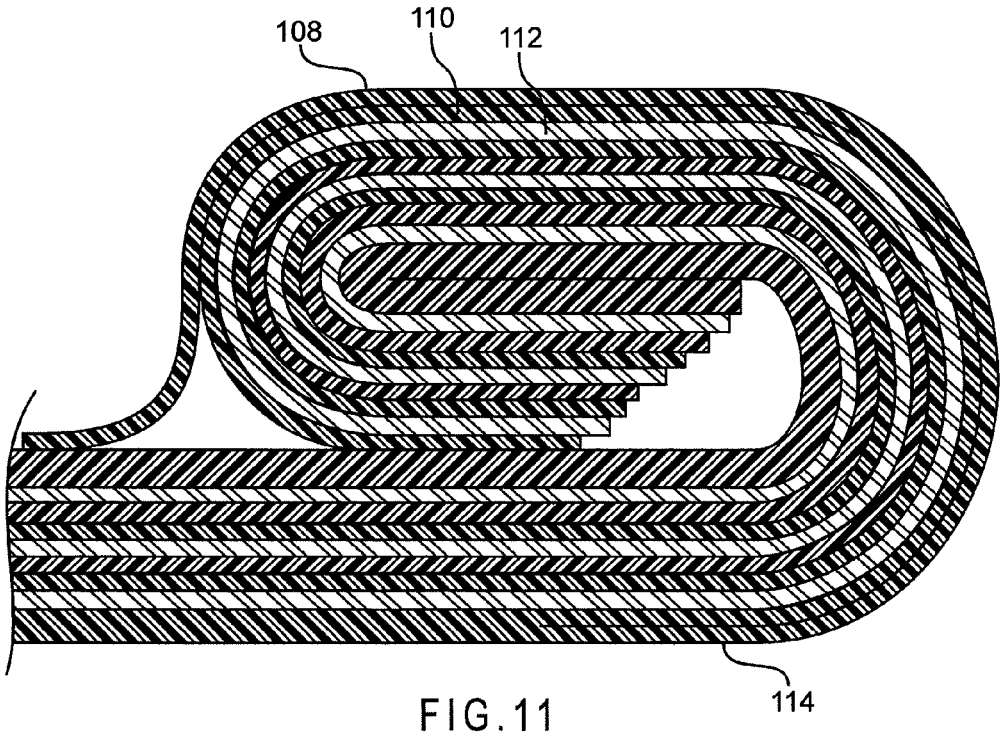
FIG. 11 is an elevation view of a partial section of the bag illustrating one embodiment of this disclosure.

FIG. 11 is an elevation view of a portion of one embodiment of the present disclosure similar to and as discussed with respect to FIG. 10. A third woven polypropylene inner layer 122 may be positioned between the second extrusion layer 120 and the polypropylene layer 66 with a second inner polypropylene layer 124 positioned between the second extrusion layer 120 and the third woven polypropylene inner layer 116. A third extrusion layer 126 may separate the second polypropylene inner layer 116 from the polypropylene layer 66. By providing additional woven polypropylene inner layers 116 and 122, the strength of the bag is increased.

As noted in parent application Ser. No. 11/441,517, the front wall 11 of the bag A may be considered the side on which prominent displays labeling or indicia comprising, for example, graphic designs, trademarks, and the like, a notional example of which is represented in FIG. 1B. Accordingly, it may also be desirable to put a coating 116 on the outer polypropylene layer 108 to improve printing qualities, as is well known in the art.

While particular embodiments of the present disclosure have been described, it will be understood, however, that the present disclosure is not limited thereto, since modifications may be made by those skilled in the art, particularly in light of the foregoing teachings. It is, therefore, contemplated by the following claims to cover any such modifications that incorporate those features or those improvements that embody the spirit and scope of the present disclosure.

What is claimed is:

1. A method of forming a bag from a tube of material, said method comprising:

opening said tube of material to separate a front side of said tube from a rear side of said tube;

folding a first end of said tube to create a closed end of said tube at said first end of said tube;

heating said closed end of said tube to seal said closed end of said tube; and cutting across said tube to form a bag having an open end and a sealed closed end, wherein said heating step is a hot air sealing process that utilizes a jet of hot air at an elevated temperature of at least 350° F., and wherein said tube consists essentially entirely of polypropylene.

2. The method of claim 1, wherein said tube of material comprises an inner layer and an outer layer, said inner layer defining a front inner layer and a rear inner layer and said outer layer defining a front outer layer and a rear outer layer.

3. The method of claim 2, wherein said folding step causes a portion of said front outer layer to contact a portion of said rear inner layer.

4. The method of claim 3, wherein said inner layer comprises woven polypropylene, wherein said outer layer comprises polypropylene film, and wherein said woven polypropylene and said polypropylene film are directly sealed to one another over the entire surface of the outer layer and the inner layer.

5. The method of claim 3, wherein said portion of said rear inner layer comprises woven polypropylene and wherein said portion of said front outer layer comprises polypropylene film and wherein said heating step causes said woven polypropylene to be heat sealed to said polypropylene film to seal said closed end of said tube.

6. The method of claim 1, wherein said hot air sealing process hot air seals said closed end of said tube at a temperature of between 375 and 550° F.

7. The method of claim 1, further comprising plasma treating said bottom end of said tube prior to completing said folding step.

8. The method of claim 1, further comprising forming a score line along said rear side of said tube to facilitate said folding step.

9. The method of claim 1, wherein hot air is directed against said bottom end of said tube by means of a nozzle which is pressed against said bottom end during manufacture of said bag.

10. A method of forming a bag from a tube of material, said method comprising:

opening said tube of material to separate a front side of said tube from a rear side of said tube;

folding a first end of said tube to create a closed end of said tube at said first end of said tube;

heating said closed end of said tube to seal said closed end of said tube; and cutting across said tube to form a bag having an open end and a sealed closed end, wherein said heating step is a hot air sealing process that utilizes a jet of hot air at an elevated temperature of between 375 and 550° F., and wherein said tube consists essentially entirely of polypropylene.

11. The method of claim 10, wherein:

said tube of material comprises an inner layer and an outer layer, said inner layer defining a front inner layer and a rear inner layer and said outer layer defining a front outer layer and a rear outer layer;

said folding step causes a portion of said front outer layer to contact a portion of said rear inner layer;

said inner layer comprises woven polypropylene;

said outer layer comprises polypropylene film; and said woven polypropylene and said polypropylene film are directly sealed to one another over the entire surface of the outer layer and the inner layer.

12. The method of claim 10, wherein:

said tube of material comprises an inner layer and an outer layer, said inner layer defining a front inner layer and a rear inner layer and said outer layer defining a front outer layer and a rear outer layer;

said folding step causes a portion of said front outer layer to contact a portion of said rear inner layer;

said portion of said rear inner layer comprises woven polypropylene;

said portion of said front outer layer comprises polypropylene film; and said heating step causes said woven polypropylene to be heat sealed to said polypropylene film to seal said closed end of said tube without an adhesive layer between said woven polypropylene and said polypropylene film.

* * * * *